United States Patent [19]

Georgelin

[11] 4,305,227

[45] Dec. 15, 1981

[54] EMERGENCY-OPENING SLIDING DOOR

[75] Inventor: Alexandre Georgelin, Bois-Colombes, France

[73] Assignee: Faiveley S.A., France

[21] Appl. No.: 110,658

[22] Filed: Jan. 9, 1980

[30] Foreign Application Priority Data

Jan. 18, 1979 [FR] France ..... 79 01230

[51] Int. Cl.[3] ..... E05C 15/02

[52] U.S. Cl. ..... 49/141; 49/164; 49/196; 49/362

[58] Field of Search ..... 49/141, 149, 164, 196, 49/362

[56] References Cited

U.S. PATENT DOCUMENTS

| | | | |
|---|---|---|---|
| 3,318,047 | 5/1967 | Carson | 49/141 X |
| 3,466,805 | 9/1969 | Muessel | 49/141 |
| 3,470,653 | 10/1969 | Kalog | 49/141 X |
| 3,670,455 | 6/1972 | Slaybaugh | 49/141 X |
| 4,007,557 | 2/1977 | Davis et al. | 49/141 X |
| 4,063,388 | 12/1977 | Little | 49/141 |

FOREIGN PATENT DOCUMENTS 2322907 11/1974 Fed. Rep. of Germany .

*Primary Examiner*—Philip C. Kannan

*Attorney, Agent, or Firm*—Finnegan, Henderson, Farabow, Garrett & Dunner

[57] ABSTRACT

The emergency-opening sliding door comprises at least one door-leaf constituted by a panel which is stationarily fixed with respect to a panel frame attached to the door casing and at least one movable panel coupled to the frame by means of a roller track which permits displacement of the movable panel in sliding motion in a direction parallel to the fixed panel. The door is provided with an articulation system for permitting a movement of rotation of at least one of the panels about a vertical axis. The driving means for displacement in sliding motion are secured to the panel frame so as to be driven together with the frame in its movement of rotation.

11 Claims, 11 Drawing Figures

EMERGENCY-OPENING SLIDING DOOR

This invention relates to an emergency-opening sliding door of the type employed for closing very large premises and rooms which are intended to receive a large number of persons at the same time.

Doors of this type usually comprise a leaf or two leaves placed opposite to each other, each leaf being constituted by a panel which is stationarily fixed with respect to a door-panel frame secured to the door casing, and at least one movable panel coupled to the panel frame by means of a roller track which permits displacement of the movable panel in sliding motion in a direction parallel to the fixed panel. The movable panel is normally in the closed position and slides automatically to the open position as a person approaches the doorway.

However, this sliding movement is relatively slow in order to ensure good performance and length of service life of the equipment; furthermore, if the occupants of the premises have any cause for panic and consequently rush towards the doorway, they may press against the door itself before it has opened to the full extent, thus preventing completion of its sliding motion.

It has been sought to overcome this drawback by endowing the movable panel with a degree of freedom of rotational motion in order to permit opening in the outward direction in the same manner as a conventional door-leaf when pressure is applied against this latter. However, there are still a number of disadvantages which remain. In the first place, safety regulations dictate the need for a movement of rotation through an angle of at least 90° so that, once the movable panel has been opened in this manner, it takes up a large area which makes it impossible to open the fixed panel in the same manner. The opening obtained is therefore limited to the width of the movable panel.

A further requirement of this operation is that the movable panel must be pivotally mounted both at the top and bottom, especially in the floor. In order to make the rotational motion compatible with the normal sliding motion, arrangements are made to mount the bottom pivot in a groove formed in the floor in order to permit both movements. In the case of public premises, however, a groove in the floor is continuously liable to become clogged with dirt and foreign matter which have the effect of interfering with the operation of the door.

The aim of the present invention is to provide an emergency-opening sliding door which makes it possible to free the maximum space while ensuring optimum reliability.

According to the invention, the emergency-opening sliding door comprises at least one leaf constituted by a panel which is stationarily fixed with respect to a panel frame attached to the door casing and at least one movable panel coupled to said frame by means of a roller track which permits displacement of the movable panel in sliding motion in a direction parallel to the fixed panel. Said door comprises an articulation system for permitting a movement of rotation of at least one of the panels about a vertical axis and is distinguished by the fact that the driving means for displacement in sliding motion are secured to the panel frame so as to be driven together with this latter in its movement of rotation.

The perimeter of the door casing is entirely free and unobstructed since both the movable and stationary panels as well as the panel frame and the driving means for displacement in sliding motion are subjected to the movement of rotation.

The opening thus left free therefore provides maximum doorway clearance both in height and in width.

According to an improved embodiment of the invention, the door comprises a stage which serves to control the driving means for automatically initiating displacement of the movable panel in sliding motion in the direction of opening when the door-leaf is caused to rotate in the direction of opening.

Once the door has been opened by rotation, the movable panel is thus brought back against the fixed panel, thereby lowering wind resistance by half and reducing the danger of breakage by reducing the area occupied.

Preferably, the stage for controlling the driving means comprises a device for actuating said driving means at a speed below the normal speed of sliding motion when the door-leaf is caused to rotate in the direction of opening.

During rotational opening of the door, the low-speed sliding motion guards against any potential danger of injuries in the event that a crowd rushes through the doorway and pushes against the door panels.

In an advantageous embodiment of the invention, the door comprises elastic means for preventing a movement of rotation of the door-leaf in the direction of opening during a fraction of the rotational travel of said door-leaf in the vicinity of its closed position.

After a transient thrust has caused partial opening of the door, this latter closes again automatically under the action of the elastic means if said thrust is not continued.

Similarly, the door comprises elastic means for producing a movement of rotation of the door-leaf in the direction of opening during a fraction of the rotational travel of said door-leaf in the vicinity of its fully open position.

Beyond a predetermined degree of opening, the elastic means aforesaid perform a contributory function in automatically ensuring complete opening of the door.

In an advantageous embodiment of the invention, the assembly of elastic means aforesaid comprises a longitudinal sliding element articulated at one end at one point of the panel frame and at the other end at one point of the door casing, said articulation points being so arranged as to be aligned with the axis of rotation of the door-leaf in an intermediate angular position of this latter.

Preferably, the longitudinal sliding element is a pneumatic jack.

In a preferred embodiment of the invention, the door comprises means which serve to lock the panel frame to the door casing and which can be released by the action of a predetermined pressure applied transversely to the door-leaf.

In consequence, the door cannot open accidentally, for example under the action of a draft. Opening of the door calls for an appreciable thrust corresponding to an intentional act.

In the event that the driving means of the movable panel comprise a screw actuated by a motor and adapted to cooperate with a nut fixed on said panel, the invention provides for a movable bar mounted on a locking mechanism secured to the panel frame, said mechanism being so arranged that the bar is capable of engaging in a toothed wheel mounted at the end of the screw in order to secure this latter against rotation and thus to arrest sliding motion.

Correlatively, the invention further makes provision for a locking-bolt which is adapted to cooperate with the door casing and serves to arrest the movement of rotation of the panel frame.

The locking mechanism is advantageously controlled by an electromagnet supplied from an independent storage battery, the locking position being intended to correspond to a lack of current.

Further properties and advantages of the invention will become apparent from the following detailed description, reference being made to the accompanying drawings which are given by way of example and not in any limiting sense, and in which.

Figure 1:
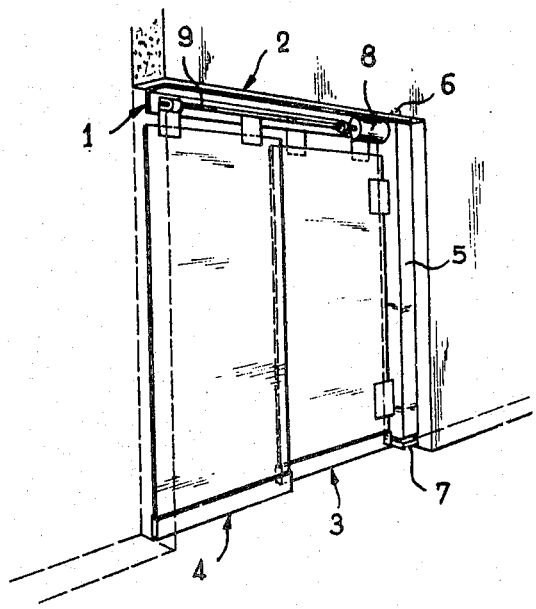
FIG. 1 is a general view in perspective showing a door according to the invention in the closed position.
Figure 2:
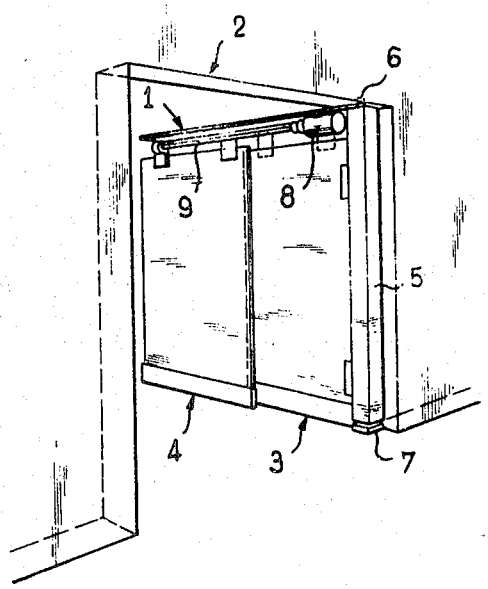
FIG. 2 is a similar view of the same door in a position in which the door has been opened by rotational displacement.

Referring to FIGS. 1 and 2, a door according to the invention comprises a frame 1 attached to the door casing 2. Said frame carries a fixed panel 3 which is rigidly attached to the frame and a movable panel 4 mounted on a roller track for sliding in a direction parallel to the fixed panel 3 in order to afford, in the open position, a passageway which is approximately equal to one-half the width of the door casing 2.

The panel frame 1 comprises a post 5 rotatably mounted on two bearings 6 and 7 placed respectively at each end of said post.

An electric motor 8 actuates an endless screw 9 which is adapted to carry a nut (not shown in FIGS. 1 and 2), said nut being rigidly fixed to the movable panel 4.

It is apparent that the door is capable of opening not only by sliding motion of the movable panel 4 but also by rotational motion of the unit consisting of both panels (as shown in FIG. 2) and that this movement of rotation also involves the panel frame 1; in consequence, the door casing 2 is left completely free and unobstructed whilst the motor 8 is also driven with the screw 9 in the movement of rotation of the frame 1.

Said door will now be described in detail with reference to FIGS. 3 to 10.

The door casing 2 comprises a lintel 11 formed by a U-section member which carries an angle-iron 12. A pivot 13 extends through a hole formed in the horizontal flange of said angle-iron and is rigidly fixed to the post 5 so as to constitute the bearing 6. The post 5 is provided at its lower end with another pivot 14 which is adapted to cooperate with a seating plate 15 so as to constitute the bearing 7.

Figure 5:
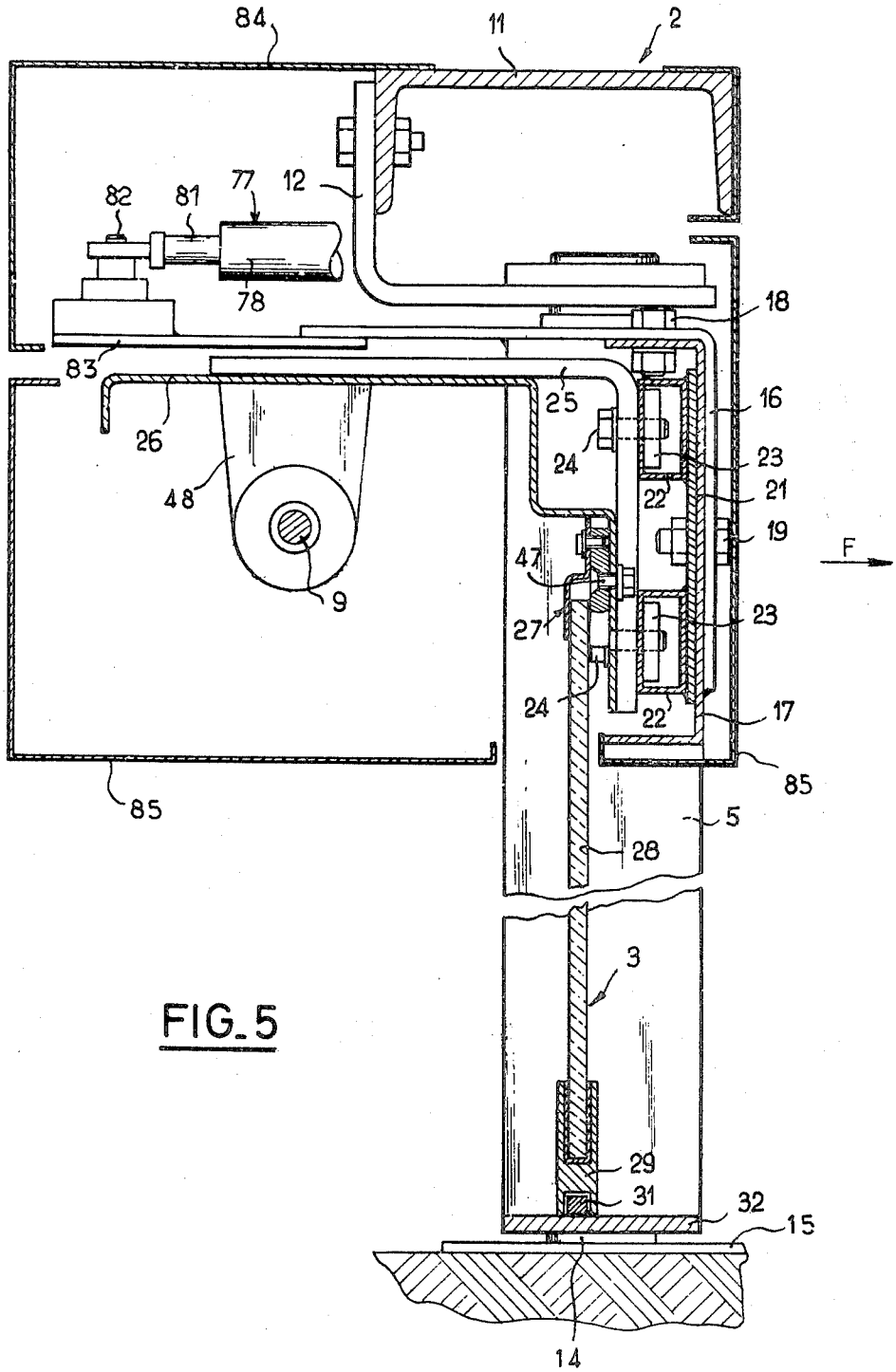
FIG. 5 is a sectional view taken along line V—V of FIGS. 3 and 4.
Figure 6:
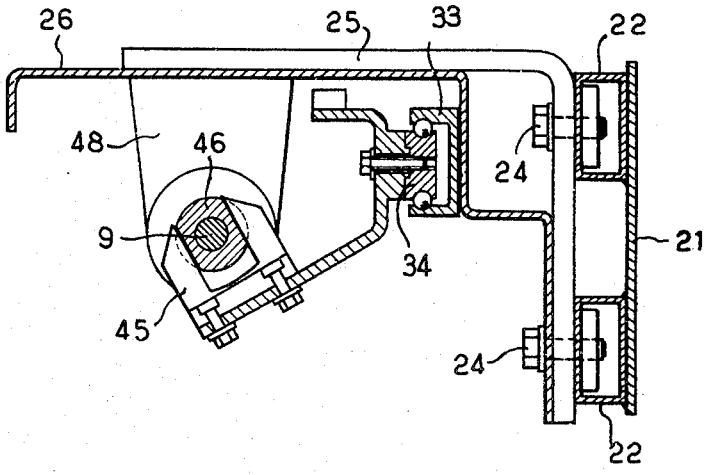
FIG. 6 is a sectional view taken along line VI—VI of FIGS. 3 and 4.

An angle-iron 16 is applied on the one hand against the top face of the square-section post 5 and on the other hand against one of the lateral faces of said post. A U-section member 17 having a vertical web is attached to said angle-iron by means of bolts 18, 19 (as shown in FIG. 5). The bolts 19 which serve to join the web of the U-section member 17 to the vertical flange of the angle-iron 16 also serve to assemble a flat plate 21 to which are welded two sections 22 of rectangular-section tube. Within said sections are housed nuts 23 which are adapted to cooperate with bolts 24 in order to hold a right-angled strengthening bracket 25 and a special sectional member 26.

Figure 3:
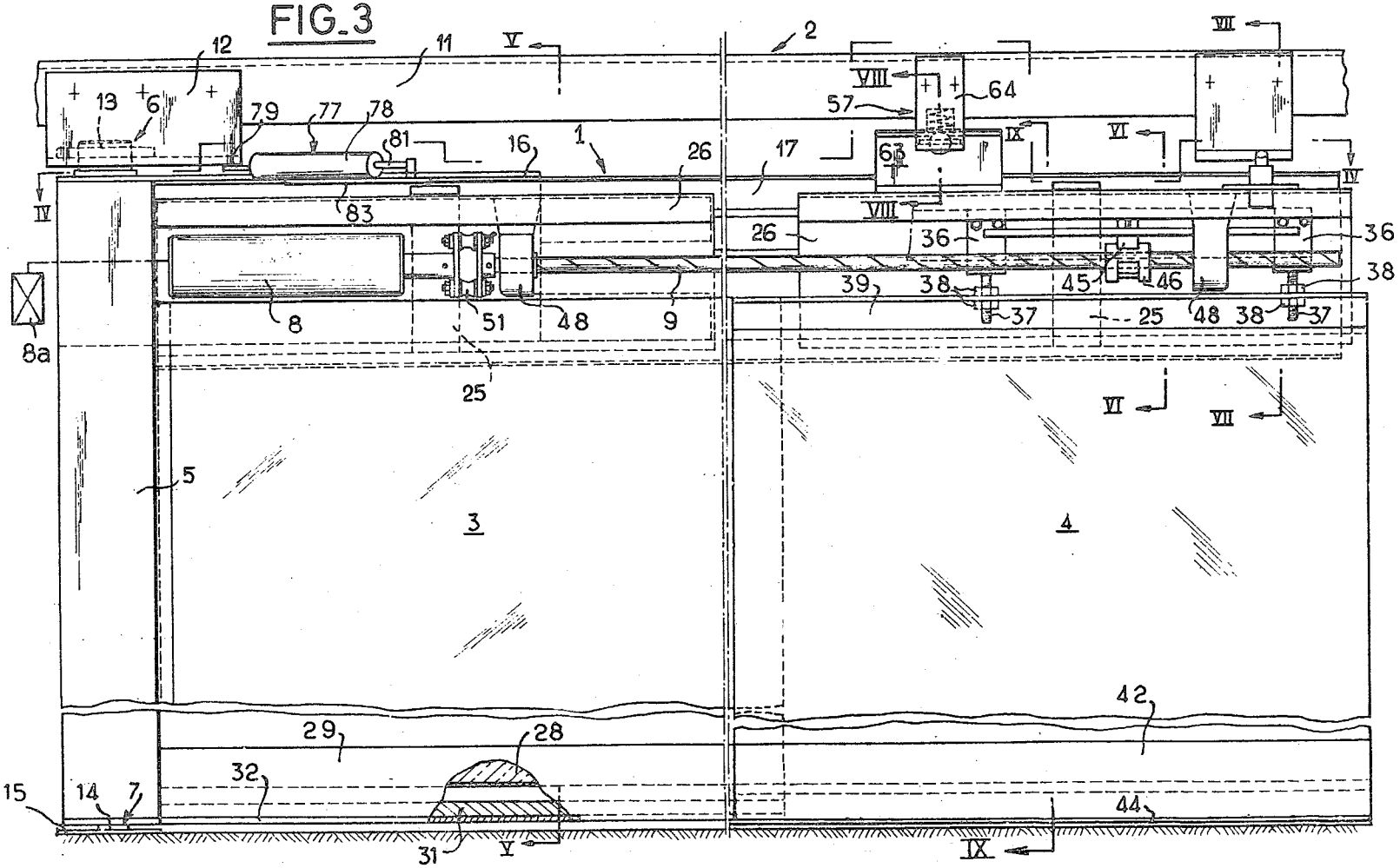
FIG. 3 is a view in elevation showing the door in the closed position, this view being taken along line III—III of FIG. 4.

Whereas the U-section member 17 extends along the entire length of the door and constitutes the main member of the panel frame 1 (as shown in FIG. 3), the special sectional members 26 are of limited length and disposed in spaced relation along the length of the frame 1, each sectional member being strengthened by its right-angled bracket 25.

Bolts 47 (shown in FIG. 5) serve to attach an edge strip 27 to the sectional member 26, said strip being attached to the top edge of a glass panel 28 which constitutes the fixed panel 3. The bottom edge of said panel is provided with an H-section plinth 29 which is adapted on the one hand to fit over said bottom edge and on the other hand to be mounted astride a square-section member 31 which is fixed on a flat member 32, said flat member being in turn attached to the lower end of the post 5.

The special sectional members 26 serve as supports for a ball cage 33 which extends along the entire length of the door and in which is slidably mounted a slide-block 34 to the ends of which are attached two flat members 36 (shown in FIGS. 3 and 9), each flat member being adapted to carry a threaded rod 37. Two nuts 38 on said threaded rod serve to clamp a horizontal flange of a sectional member 39 and this latter forms the top edge member of a glass panel 41 which constitutes the movable panel 4.

Figure 10:
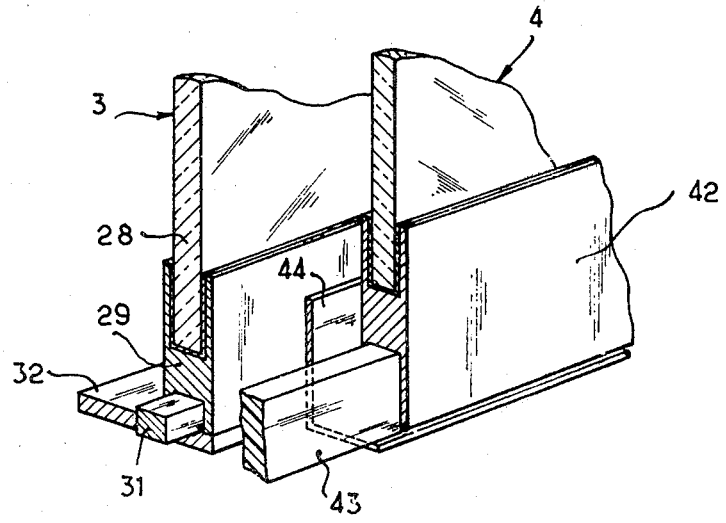
FIG. 10 is a fragmentary part-sectional detail view in perspective showing the lower portion of the door-leaves.

Said movable door-leaf is provided at the lower end with a plinth 42 (FIG. 9) which is similar to the plinth 29 of the fixed door-leaf 3 and is mounted astride a rectangular-section member 43 of plastic material along which said plinth is adapted to slide with slight friction. The sectional member 43 is fixed on an angle-iron 44 and this latter is in turn fixed on the plinth 29 of the fixed door-leaf 3 (as shown in FIG. 10).

In connection with the lower ends of the door-leaves 3 and 4, it follows from the foregoing that neither of these latter is in contact with the floor.

The central portion of the slide-block 34 is adapted to carry a fork 45 (FIG. 6) and this latter serves to clamp a ball-mounted nut 46 which cooperates with an endless screw 9. Two bearings 48 (FIG. 3) which are attached to the special sectional members 26 are adapted to carry said endless screw 9 which is coupled to an electric motor 8 by means of a sleeve 51.

The motor 8 is attached to the special sectional member 26 by known means (not shown in the drawings) and is provided with an automatic control stage **8*a*** of a type known per se in order to initiate automatic start-up of the motor in the direction of opening or closing, depending on whether a person or a vehicle is moving respectively towards or away from the door.

In the example herein described, provision is made for programming of the control stage in order to operate the motor at a predetermined speed of relatively high value over the greater part of its travel and at a low speed near the ends of travel of the movable panel 4 with a view to minimizing shocks at the end of travel. This arrangement is already known per se and need not be described in detail here.

It follows from the description given thus far that the assembly constituted by the panels 3 and 4 and the frame 1 is capable of pivotal displacement about the axis of the post 5 so that the door opens in a movement of rotation in the direction of the arrow F (as shown in FIGS. 4, 5, 7, 8).

Figure 4:
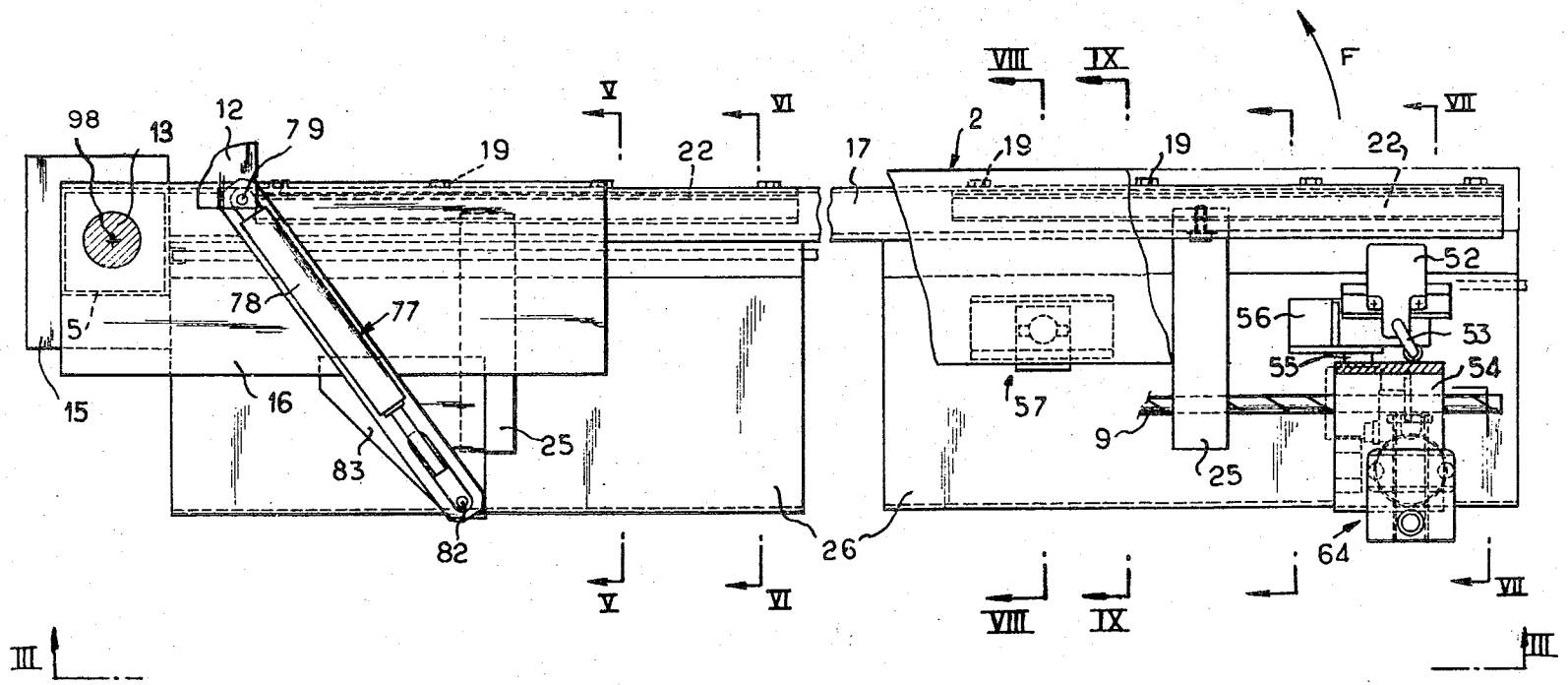
FIG. 4 is a plan view of the door, taken along line IV—IV of FIG. 3.
Figure 7:
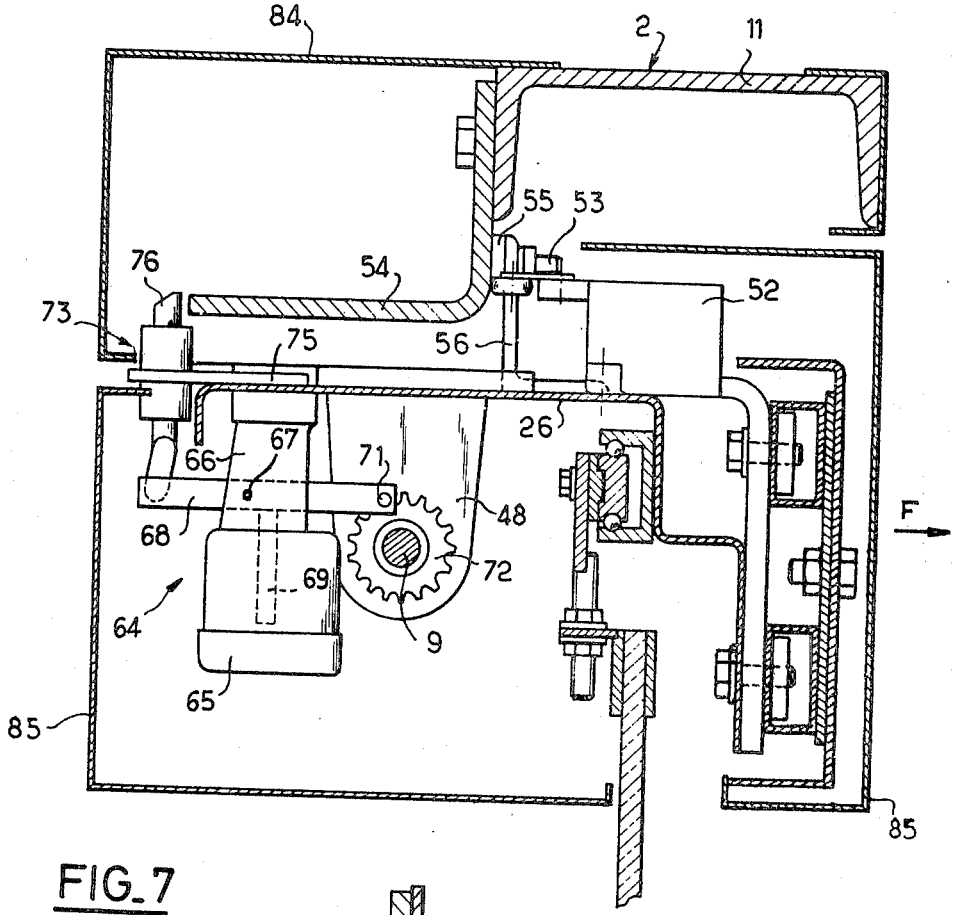
FIG. 7 is a sectional view taken along line VII—VII of FIGS. 3 and 4.
Figure 8:
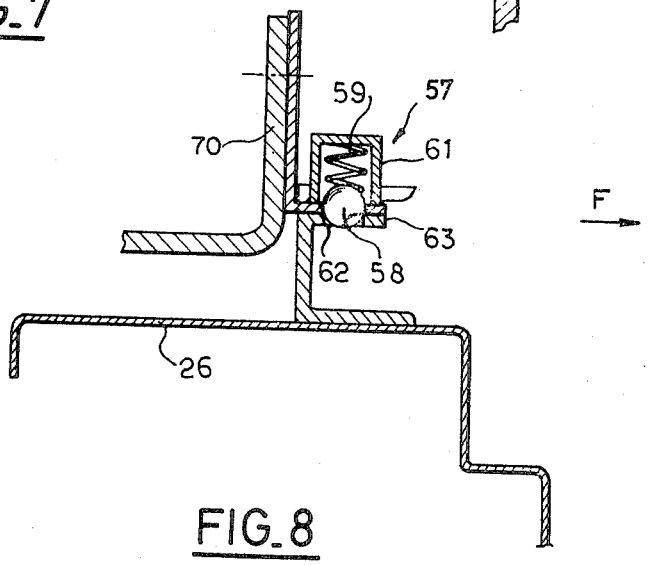
FIG. 8 is a sectional view taken along line VIII—VIII of FIGS. 3 and 4.
Figure 9:
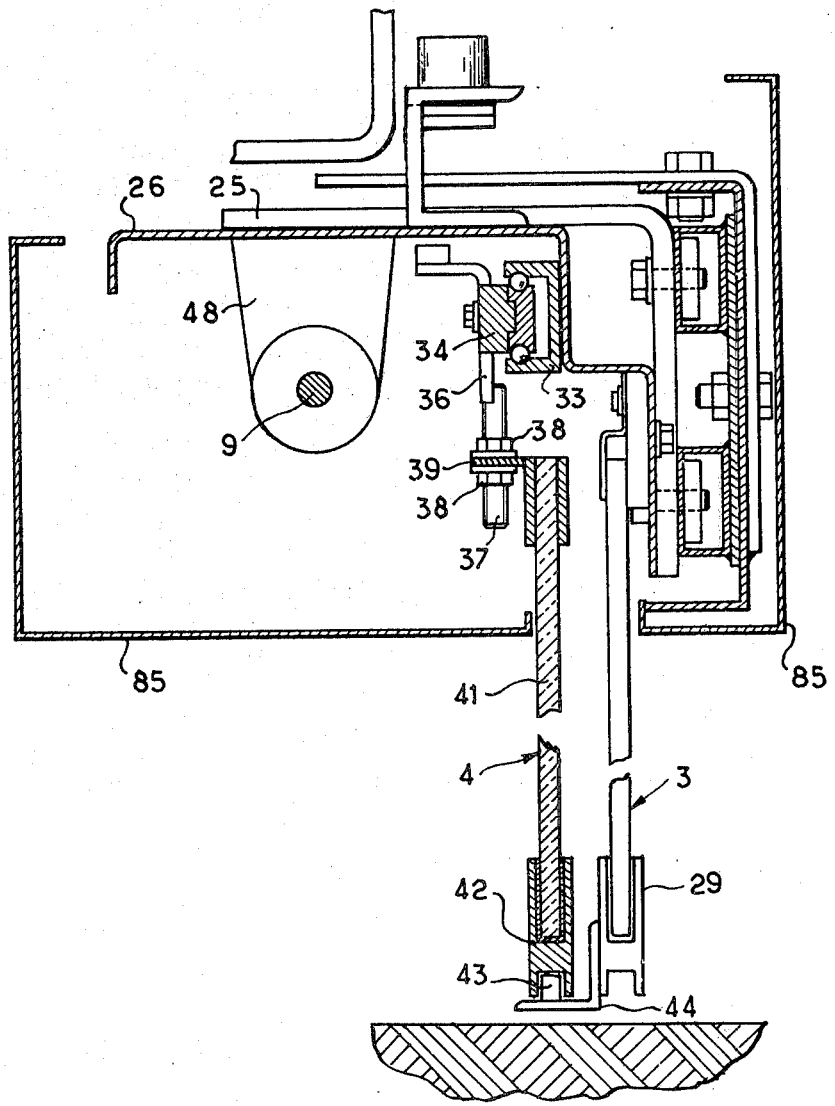
FIG. 9 is a sectional view taken along line IX—IX of FIGS. 3 and 4.

In the vicinity of that end of the door which is remote from the post 5, a contactor 52 is fixed on the special sectional member 26, a movable arm 53 being applied against an angle-iron 54 which is attached to the lintel 11 (as shown in FIGS. 4 and 7). It is apparent that, when the door is displaced in a movement of rotation, the arm 53 moves so as to actuate the contactor 52. The contactor is connected to the programmed control stage of the motor 8 in order to initiate start-up of the motor 8 at low speed in the direction of opening as soon as the door begins a movement of rotation in the direction of opening.

A stop 55 of resilient material is fixed on a right-angled member 56 which is secured to the special sectional member 26 in order to bear on the angle-iron 54 when the frame 1 of the door is in the closed position (as shown in FIGS. 4 and 7).

A ball catch 57 (shown in FIG. 8) is constituted by a captive ball 58 which is urged to a projecting position by a spring 59 housed within a casing 61 in order to cooperate with an orifice 62 formed in a channel strip 63 which is rigidly fixed to the special sectional member 26, the casing 61 which retains the captive ball being in turn attached to an L-section strip 70 which is rigidly fixed to the lintel 11.

A locking device 64 (shown in FIG. 7) comprises an electromagnet housed within a casing 65 which is attached to the special sectional member 26 by means of a leg 66. A lever 68 is pivotally attached to the leg 66 at 67 and connected to an armature 69 of the electromagnet. One end of said lever is constituted by a bar 71 and this latter is capable of cooperating with a toothed wheel 72 which is keyed on the endless screw 9. A latch 73 is pivotally mounted at the other end of the lever, the latch body 74 being fixed in a flat plate 75 which is rigidly fixed to the special sectional member 26.

The electromagnet is so arranged that the armature 69 is driven upwards in the event of excitation and returns downwards under the action of elastic means (not shown in the drawings) in the event of current failure. In the current failure position (shown in FIG. 7), the locking-bolt 76 is displaced upwards with respect to the angle-iron 54 and the bar 71 is engaged in the toothed wheel 72. In the event of excitation, these positions are reversed, in which case the toothed wheel 72 is released and the locking-bolt 76 is withdrawn.

In the example herein described, the electromagnet is supplied from an independent storage battery.

A jack 77 (shown in FIGS. 3 and 4) is mounted at that end of the door which is adjacent to the post 5. The jack body 78 is pivotally mounted at 79 on the angle-iron 12 which is attached to the lintel 11. The operating rod 81 of the jack is pivotally mounted at 82 on a gusset-plate 83 and this latter forms an extension of the angle-iron 16 which is rigidly fixed to the post 5.

Figure 11:
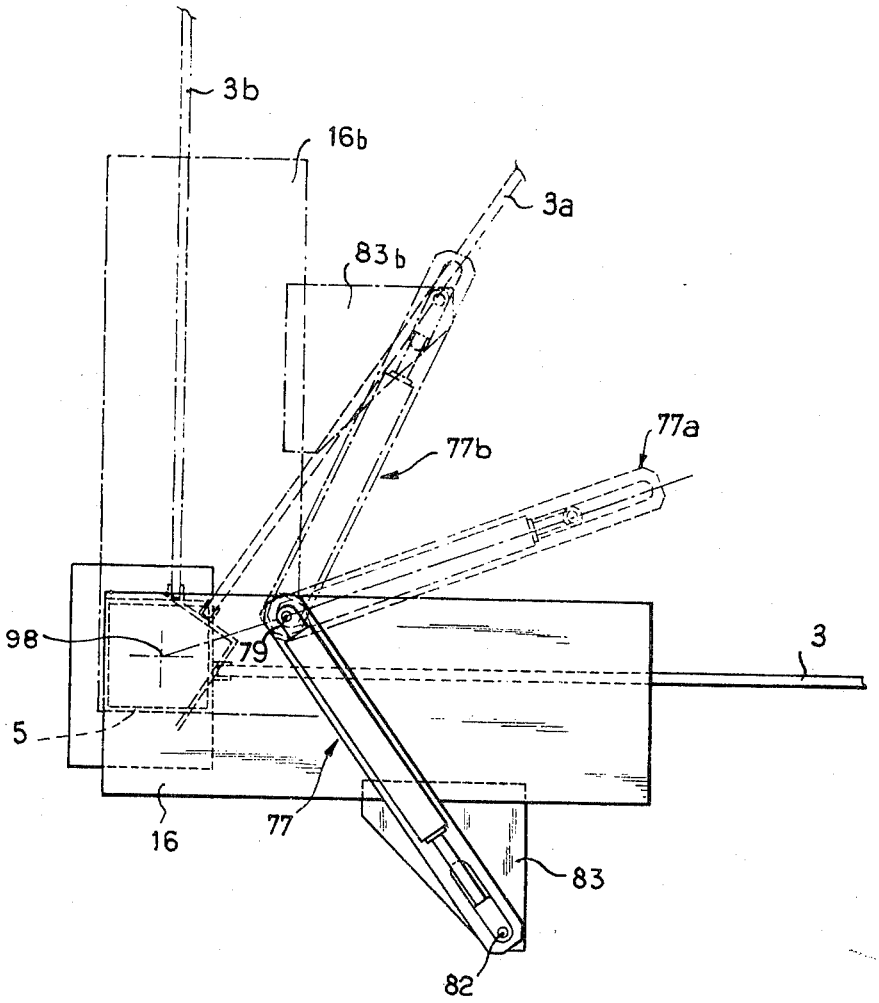
FIG. 11 is a schematic view which is intended to explain the operation of the door.

The articulation points 79 and 82 are so arranged as to be aligned with the axis 98 of the post 5 in an intermediate position of the door in the movement of rotation of this latter (as shown in FIG. 11), that is, in the position **77*a*** of the jack as shown in dashed outline.

The jack 77 works continuously in compression and can be of the spring-controlled type or of the compressed-air type as in the example herein described.

In the closed position 3 of the fixed panel, the jack in position 77 (shown in FIG. 11) prevents opening of the door until the panel reaches position **3*a* (shown in dashed lines) which corresponds to position 77*a* of the jack. Beyond this point and up to the fully open position 3*b* of the panel (shown in chain-dotted lines) corresponding to position 77*b*** of the jack, the jack provides assisted opening of the door.

Finally, a cover 84 attached to the lintel 11 and a cover 85 attached to the panel frame 1 conceal and protect the mechanisms hereinabove described. For the sake of enhanced clarity of the drawings, it has been assumed in FIGS. 1 to 4 that these covers have been removed.

The operation of the door will now be described.

From the closed position as shown in all the drawings (except in FIG. 2), the normal operation of the door consists in displacement of the movable panel 4 in sliding motion in a direction parallel to the fixed panel 3 under the action of the motor 8 which drives the endless screw 9 in rotation, thus producing a displacement of the nut 46 in translational motion and the same displacement of the fork 45.

The motor 8 can be started up either by hand by depressing a push-button or automatically (as in the example under consideration) as a person or a vehicle approaches the doorway.

The same movement takes place in the opposite direction for the door-closing operation.

In both cases, the movable panel moves at high speed over the greater part of its travel and at low speed in the vicinity of the ends of travel.

Under conditions of normal service, only the sliding movement mentioned above is intended to take place since the panel frame 1 is secured against rotation by the ball catch 57 which prevents rotation of the panels solely under the action of a draft or of a light thrust exerted accidentally on the door.

If the accidental thrust just mentioned corresponds to a relatively high effort, it may have the effect of forcing the ball catch 57 and allowing the door to open to a partial extent. But if the person who has exerted this effort does not continue to do so, the door re-closes under the action of the jack 77 which acts in opposition to the opening movement.

If the thrust is both of high value and continuous, the door continues to open until it moves beyond the position **77*a* of maximum compression of the jack, whereupon said jack assists opening of the door. At the same time, the contactor 52 initiates displacement of the movable panel 4** in sliding motion in the direction of opening and at low speed. The low speed makes it possible to prevent any possibility of injury to persons who may press against the door whilst the progressive opening motion reduces the space swept by the rotating panels and reduces wind resistance of the panels by half when the rotational displacement has been completed.

In the position of non-utilization of the door under such conditions as overnight closure, for example, actuation of the locking device 64 serves to arrest the two possible movements of the door, namely in sliding motion by means of the toothed wheel 72 and in rotational motion by means of the latch 73. Since the locking position corresponds to failure of the current supply, this provides an additional burglar-proof effect.

Under conditions of normal use, a failure of the mains supply cannot give rise to accidental locking of the door since the supply of current to the electromagnet is independent.

The door according to the invention has the important advantage of leaving a completely free and unobstructed passageway as defined by the door casing 2, not only across the full width of the casing as a result of withdrawal of both panels but also to the full height of the casing as a result of withdrawal both of the panel frame and the mechanism contained within this latter (as shown in FIG. 2).

The result thereby achieved is that, should any incident occurring on the premises have the effect of inducing a state of panic among a crowd of people, the largest possible space is afforded for evacuation of the premises. Similarly, if rotational opening is made necessary in order to allow a vehicle such as a truck to pass through the doorway, the available headroom provides sufficient clearance for vehicles having substantial overall dimensions.

The use of a door of this type is justified not only from the standpoint of safety of persons in the event of panic but also in order to protect the door itself in the event of its being struck accidentally by a vehicle. The fact that the door yields readily in rotational motion serves to prevent it from sustaining any serious damage.

It will further be noted that the panels do not bear on the ground or floor at any point but are suspended from the panel frame. Rotation of the panels does not therefore entail the need for any rolling motion or consequently for any roller track formed in the floor and subject to the risk of clogging with foreign matter.

As will be readily apparent, the invention is not limited to the example hereinabove described and many alternative forms could be contemplated without thereby departing either from the scope or the spirit of the invention. Thus it follows that the electric motor and the screw and nut system could be replaced by a hydraulic or pneumatic jack. Similarly, it would be an easy matter to contemplate a door consisting of four panels so arranged as to have two leaves which are capable of displacement in rotational motion without thereby entailing any appreciable modification of the structure hereinabove described.

What is claimed is:

1. An emergency-opening sliding door comprising at least one leaf constituted by a panel which is stationarily fixed with respect to a panel frame attached to the door casing and at least one movable panel coupled to said frame by means of a roller track which permits displacement of the movable panel in sliding motion in a direction parallel to the fixed panel by virtue of driving means for displacement in sliding motion, said door being provided with an articulation system for permitting a movement of rotation of at least one of the panels about a vertical axis, wherein the driving means for displacement in sliding motion are attached to the panel frame so as to be driven together with said frame in its movement of rotation.

2. A door according to claim 1, wherein said door comprises means which serve to lock the panel frame to the door casing and which can be released by the action of a predetermined pressure applied transversely to the door-leaf.

3. A door according to claim 1, wherein said door comprises a stage which serves to control the aforesaid driving means for automatically initiating displacement of the movable panel in sliding motion in the direction of opening when the door-leaf is caused to rotate in the direction of opening.

4. A door according to claim 3, wherein the stage for controlling the driving means comprises a device for actuating said driving means at a speed below the normal speed of sliding motion when the door-leaf is caused to rotate in the direction of opening.

5. A door according to claim 1, wherein said door comprises elastic means for preventing a movement of rotation of the door-leaf in the direction of opening during a fraction of the rotational travel of said door-leaf in the vicinity of its closed position.

6. A door according to claim 5, wherein said door comprises elastic means for producing a movement of rotation of the door-leaf in the direction of opening during a fraction of the rotational travel of said door-leaf in the vicinity of its full open position.

7. A door according to claim 5 or claim 6, wherein the elastic means comprise a longitudinal sliding element articulated at one end at one point of the panel frame and at the other end at one point of the door casing, said articulation points being so arranged as to be aligned with the axis of rotation of the door-leaf in an intermediate angular position of said door-leaf.

8. A door according to claim 7, wherein the longitudinal sliding element is a pneumatic jack.

9. A door according to claim 1, wherein the driving means for displacement of the movable panel in sliding motion comprise a screw actuated by a motor and adapted to cooperate with a nut fixed on said panel, wherein said door comprises a movable bar mounted on a locking mechanism attached to the panel frame, said mechanism being so arranged that the bar is capable of engaging in a toothed wheel mounted at the end of the screw in order to secure said screw against rotation.

10. A door according to claim 9, wherein the locking mechanism comprises a locking-bolt so arranged as to cooperate with the door casing.

11. A door according to claim 9 or claim 10, wherein the locking mechanism is controlled by an electromagnet supplied from an independent battery and the locking position of said mechanism corresponds to a failure of the current supply.

* * * * *